United States Patent [19]

Hormann

[11] Patent Number: 4,794,972

[45] Date of Patent: Jan. 3, 1989

[54] DOOR LEAF MEMBER

[75] Inventor: Michael Hormann, Steinhagen, Fed. Rep. of Germany

[73] Assignee: Hormann KG Brockhagen, Steinhagen, Fed. Rep. of Germany

[21] Appl. No.: 7,106

[22] Filed: Jan. 27, 1987

[30] Foreign Application Priority Data

Jan. 27, 1986 [DE] Fed. Rep. of Germany ... 8601984[U]

[51] Int. Cl.[4] ..... F06B 3/12

[52] U.S. Cl. ..... 160/236; 403/363

[58] Field of Search ..... 160/236; 49/501; 52/827, 828, 822, 821; 403/363, 279, 282, 289, 382

[56] References Cited

U.S. PATENT DOCUMENTS

| | | | |
|---|---|---|---|
| 1,684,966 | 9/1928 | OConor | 52/828 X |
| 2,260,590 | 10/1941 | Speck | 52/828 X |
| 2,657,645 | 11/1953 | Ecoff | 52/828 X |
| 2,723,731 | 11/1955 | Schaaf | 403/382 X |
| 4,008,745 | 2/1977 | Bailey | 160/236 X |
| 4,367,819 | 1/1983 | Lewis | 248/205.3 X |

*Primary Examiner*—Ramon S. Britts
*Assistant Examiner*—Blair M. Johnson
*Attorney, Agent, or Firm*—Antonelli, Terry & Wands

[57] ABSTRACT

A sectional overhead door which, in its longitudinal rims pointing in the direction of movement, is inwardly angled in a C-shape and stabilized at marginal zones, by reinforcing struts extending in the direction of movement of the door, with the reinforcing struts contacting the sheet-metal panel of the door leaf member extending in the plane of the door leaf member, and being in shape-mating connection in their two end zones at the front face C-shaped angled portions extending in parallel to the plane of the door leaf member. The reinforcing struts, in their contact zone against the inside of the sheet-metal panel are glued to the door leaf member and are in shape-mating connection with the rims of the C-shaped angled portions projections in end zones of the reinforcing strut extending at the front face over the rims of the C-shaped angled portions, or of the rims, engaging with practically no play in openings in the rims and, respectively, the end sections of the reinforcing strut at the front face, as viewed in the longitudinal direction of the reinforcing strut.

7 Claims, 3 Drawing Sheets

DOOR LEAF MEMBER

BACKGROUND OF THE INVENTION

The present invention relates to a laminate door leaf member of a sectional overhead door, of a multiple-part door leaf adapted to be moved vertically or horizontally into a closed position or of a similar building closure.

Sectional overhead doors generally include laminate door leaf members which are adapted to be moved vertically or horizontally into a closed position, with the door leaf member comprising substantially C-shaped angled portions provided along longitudinally rims thereof and disposed so as to face an interior of an area to be closed by the overhead door. Generally reinforcing strut means, extending perpendicular to a direction of the longitudinal rims and in a direction of movement are provided at the marginal zones of the door and, also, optionally, between the marginal zones, with the reinforcing strut means stabilizing the marginal zones and/or areas therebetween. The reinforcing strut means are placed in contact with a laminate sheet-metal panel of the door leaf member.

In conventional louvered door leaf members, manufactured from thin sheet metal, lateral reinforcing struts are joined to the door leaf members by welding, with the reinforcing struts extending in a direction of movement of the door leaf member. Additionally, it is also possible to provide one or more reinforcing struts in uniform distribution along the louvered door leaf member. The welding is normally accomplished by spot welding or by a comparable welding operation by welding coins.

A disadvantage of the conventional approach resides on the fact that the areas of the sheet-metal panel and the reinforcing strut to be welded must not electrically be insulated from each other. If, for example, insulation was initially provided at the individual parts or components in the form of a primer on the laminate sheet-metal panel and/or on the reinforcing strut profiles, the insulation would subsequently have to be removed. If such removal was not undertaken, the door leaf member can only be provided with a weatherable coating and/or paint after the welding has been accomplished between the panel and the reinforcing struts.

By virtue of the position of coating and/or paint only after the welding, a further disadvantage resides in the fact that there is an interruption in the manufacturing process and it is hardly possible to provide the corner zones and hidden surfaces which occur after the welding operation between the welded-together parts around the spot weld with an adequately secured coat of paint or to protect such areas against rusting.

Moreover, laminate metal sheets, joined only in a spot welded fashion with the reinforcing struts, tend to develop considerable noise when exposed to wind and especially during the movement thereof.

The aim underlying the present invention essentially resides in providing a door leaf member of the aforementioned type which is substantially simpler in construction and is protected with a substantially greater resistance against environmental influecnes as well as a door leaf member which develops less noise.

In accordance with the advantageous features of the present invention, adhesive means are provided for securing the reinforcing strut means in a contact zone of the reinforcing strut means at an inside or interior surface of the laminate sheet-metal panel. Connection means are provided at opposite ends of the reinforcing strut means for providing a shape meeting connection at a front face of edges of the C-shaped angled portions, with the connection means including lug-projections extending in a front face thereof over the edges of the C-shaped angled portions and being adapted to engage without any substantial play into one of openings provided in the edges of the C-shaped angled portions or openings in front end sections of the reinforcing strut means, as view in a longitudinal direction of the reinforcing strut means. According to the present invention, a connection technique between the sheet-metal panel and the reinforcing struts results in the components, combined into a dimensionally stable door leaf member, namely, the sheet-metal panel and the reinforcing strut means, being joined after the laminate sheet-metal panel has been finished by coating, baking of the paint or by some other surface treatment.

In the same manner, the reinforcing strut means can be made available with their surface being protected prior to joining the same with the laminate sheet-metal panel. The profiled struts preferably includes substantially U-shaped profile members which are cut to a desired length. In this connection, preferably galvanized sheets are utilized and, in the event that cut edges remain unprotected, this is not of any considerable significance since any rust developing at such location would not impair the ruggedness of the reinforcing strut means and would not be apparent from the exterior.

The reinforcing strut means with a complete surface treatment are glued to the laminate sheet-metal panel of the door leaf member in a flat fashion so that a firm bond is achieved. This gluing bond is limited to the inner surface of the sheet-metal panel lying in the door leaf plane. The C-shaped angled portions defining the sheet-metal panel vertically to the direction of movement of the door leaf are not included in this glue bond. Due to the thin metal sheet employed, the dimensional stability of this angled portion is minor. For this reason, the reinforcing struts are joined in a shape-mating fashion, with end sections projecting in their longitudinal extension, to the edges of the angled portion lying in the door leaf plane in such a manner that, an already present surface treatment, coating, paint cover, or the like, does not interfere. The end sections of the reinforcing struts extend in parallel position over the insides of the edges of the C-shaped angled portion and are connected in this zone to the edges by lug-type projections extending vertically to the direction of movement of the door provided at one of the mutually contacting components. The lug-type projections engage into an opening provided in the other component and extend behind the rim of the opening extending approximately vertically to the direction of movement of the door. In this connection, the play between the projections and the opening is maintained small in the door leaf movement direction so that the mutual spacings of the rims of the upper and of the lower development of the sheet-metal panel is fixed via the reinforcing struts.

Preferably, the reinforcing struts provided in the two marginal zones of the sheet-metal panel, extending in the direction of movement of the door leaf, are equipped with a covering forming a reinforcing profile, with the covering preferably being pushed onto the door leaf member from the side, namely while grasping the respective lateral reinforcing strut and the marginal zone of the sheet-metal panel glued thereto. The reinforcing profile preferably extends over the entire length of the respective marginal zone of the door leaf member and thus over the end sections of the reinforcing strut and, consequently, also over the regions of the edges of the lower and upper C-shaped development of the sheet-metal panel located at that point. In the overlapping zone, a mating tab is punched out in such a way that it projects, after having been bent away, into the opening already engaged by the two projections. The dimensioning is such that the width of the mating tab punched free into the direction of movement of the door leaf is approximately the distance between the two projections engaging into the opening.

In this manner, the reinforcing profile is securely held with approximately no play against shifting laterally with respect to the direction of movement of the door, and thus cannot be removed from its pushed-on position and/or from the grasping mounting.

This already shape-mating connection between the sheet-metal panel and the reinforcing struts and/or additionally the reinforcing profile is further firmly secured for the door operation by virtue of the fact that respectively on both sides of the opening and/or of the projections 22, bores 22 are provided which are arranged in alignment in the end sections of the reinforcing struts and the edges of the C-shaped developments of the sheet-metal panel. A reinforcing profile arranged along the edge has bores located in corresponding alignment, with the threaded bolts being passed through these bores. Insofar as a longitudinal rim of the door leaf member, extending transversely to the direction of movement of the door leaf, is followed by the longitudinal edge of a subsequently arranged door leaf member, the screws additionally pass through bores that are in corresponding alignment and are provided in fittings of threads which hingedly join the successive door leaf members in this zone.

In order to minimize if not avoid generation of noise as far as possible and/or to damp the transfer of noise between the sheet-metal panel and the reinforcing struts, the layer of adhesive is preferably provided with a certain thickness. The adhesive is permanently elastic, i.e. even after "hardening", it is still elastically resilient in a certain way. Thereby, an additional, special contribution is made toward the prevention of noise generation.

The above another objects, features, and advantages of present invention will become more apparent from the following description when taken in connection with the accompanying drawings which show, for the purpose of illustration only, several embodiments in accordance with the present invention.

DETAILED DESCRIPTION

Figure 1:
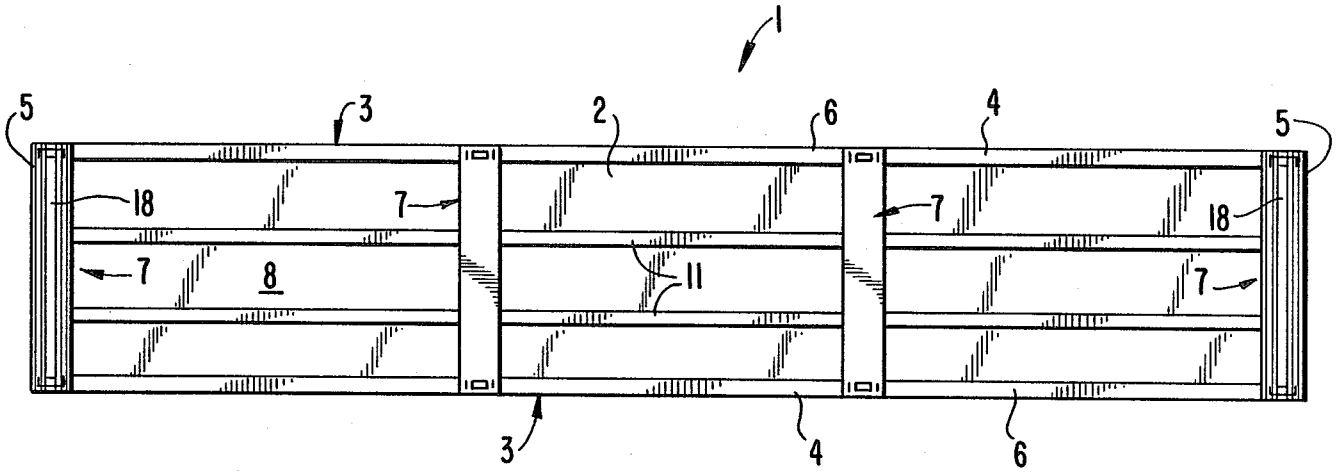
FIG. 1 is an elevational view of an interior of a door leaf member according to the present invention.
Figure 2:
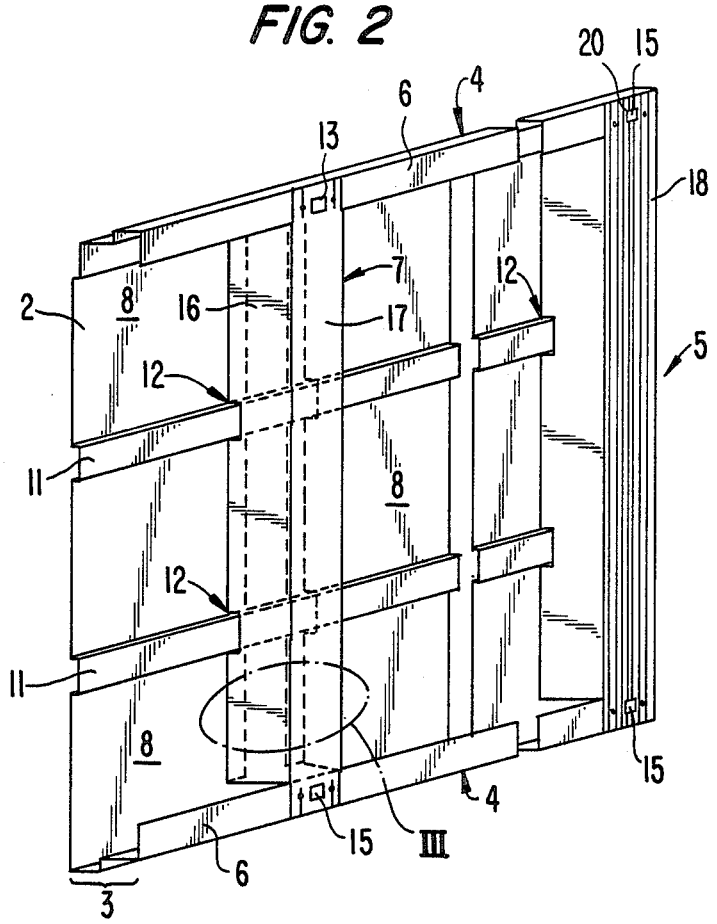
FIG. 2 is a partial perspective view of a portion of an interior of the door leaf member of FIG. 1.
Figure 4:
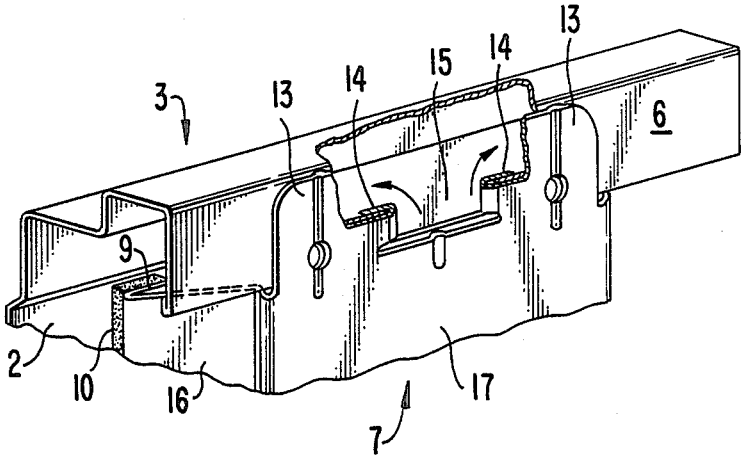
FIG. 4 is a partial perspective view of a connection arrangement between an end section of a reinforcing strut means and an associated rim of one of the two C-shaped angled portions of a sheet-metal panel of the door leaf member.
Figure 5:
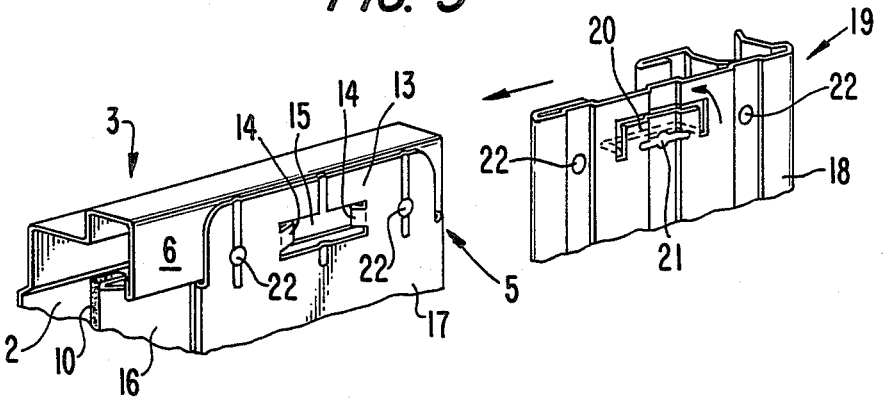
FIG. 5 is an exploded view of a connecting zone between the end section of a reinforcing strut means along the rim and the associated C-shaped angled portion of the sheet-metal panel, and a corresponding end section of a reinforcing profile, in a pulled-apart condition.

Referring now to the drawings when like reference numerals are used throughout the various views to designate like parts, and, more particularly, to FIG. 1, according to this figure, a sectional overhead door includes a plurality of door leaf members 1, each including a sheet-metal panel or slat 2 having C-shaped angled portions which, as shown in FIGS. 2, 4 and 5, are disposed along longitudinal rims of the sheet-metal panels 2 and are initially bent at a right angle and a step fashion from an inner surface 8 of the sheet-metal panel 2. The C-shaped angled portions 3 terminate in an edge 6 which extends in parallel to a plane of the door leaf member 1.

Free ends of the edges 6 of the two angled portions 3, formed on the longitudinal rims 4, are oriented toward each other, and the sheet-metal panel or slat 2 is rigidly held in its prescribed shape by reinforcing strut means 7. The reinforcing strut means 7, arranged at marginal zones 5 of the sheet-metal panel 2 extend in a direction of movement of the door leaf. The reinforcing struts 7 are encompassed by reinforcing profiles 18 described more fully hereinbelow in connection with FIG. 5. The reinforcing profiles 18 cover the marginal zones 5 in a box-shape and reinforce the marginal zones of the door. A rope of a weight-balancing device respectively engages both sides at a lowermost panel of the sectional overhead door.

Figure 3:
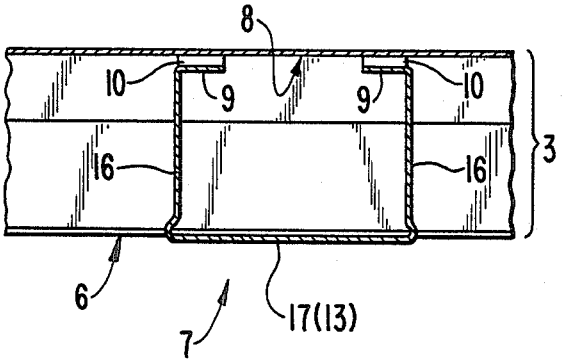
FIG. 3 is a partial sectional detail view, taken through a plane designated III in FIG. 2.

As shown in FIGS. 2 and 3, each reinforcing strut means 7 includes a substantially U-shaped profiled metal plate having legs 16 which, at a free end thereof, have portions which are bent inwardly toward each other, and marginal webs describing a plane extending in parallel to the inner surface 8 of the sheet-metal panel or slat 2. Adhesive layers 10 are provided between the outsides of the marginal webs 9 of the reinforcing struts 7, facing the inner surface 8, and the adjoining zone of the inner surface 8, made up of an adhesive which, even after setting exhibits permanently elastic properties in such a manner that noise attenuation is provided in the transitional zone between the reinforcing struct means 7 and the sheet-metal panel or slat 2 and so that the sheet metal panel or flat 2 is retained at the strut means 7 in a vibration-damping fashion by means of the large-area, strip-shaped adhesive layers 10.

As shown in FIGS. 1 and 2, the sheet-metal panel or slat 2 is provided, in a region between the C-shaped angled portions 3, with corrugations 11 extending in parallel thereto, with the corrugations 11 running approximately vertically to the reinforcing struts 7 extending in the direction of movement of the door leaf. In the zone of the corrugations 11, the ends of the legs 16 of strut 7 facing the inner surface 8 of the sheet-metal panel or slot 2 are provided with recesses generally designated by the reference numeral 12 encompassing the respectively passing corrugation 11 at a relatively large play so that no special requirements are required to insure the manufacturing accuracy in the adaptation between corrugation 11 and recess 12. In the zone of the recesses 12, the marginal webs 9 of the struts 7 are interrupted as shown in FIG. 2. The adhesive layers 10 are limited to the marginal webs 9 so that gap areas free of adhesive and contact are formed between the recesses 12 and corrugations 11.

As shown in FIG. 3, the dimensioning of the legs 16 with respect to the base 17 of the U-shaped strut profile connecting same is such that the connecting base 17, with regard to its two end sections 13 provided at the end face, is in contact with the areas of the edges 6 extending in parallel to the inner surface 8, as clearly shown in FIGS. 2, 4, and 5. A rectangular opening 15 is provided approximately in a central region of the surface areas of the edges 6 of the angled portions 3 covered by each end section 13 of the reinforcing strut means 7. The rectangular opening is preferably extends in the longitudinal direction of the longitudinal rims 4 and thus of the edges 6 of the angled portions 3 for a greater distance than vertically thereto.

A punched-out section, respectively corresponding with the opening 15, is provided in the end sections 13 of the struts 7, by which two lug-shaped projections 14 are formed which face each other in the direction of the longitudinal rim. Each of the projections 14 is bent about the adjoining, short rim of the opening 15 extending in the direction of movement of the door leaf as shown most clearly in FIG. 4 which illustrates the contact area between an end section 13 and an edge 6 and clearly shows the grasping engagement and/or subtending of the narrow opening rims 15 by the projections 14. The width of the projections 14 and the length of the short rims of the opening 15 about which the projections 14 are bent, are adapted to one another in such a way that a displacement movement of the reinforcing strut means with respect to the C-shaped angled portion 3 is precluded at least approximately without any play. In this manner, the two C-shaped angled portions 3 are held with dimensional constancy in the two longitudinal rims 4 of the sheet-metal panel or slot 2 by the reinforcing strut means 7 and constitute a unilaterally open box structure that is rugged enough for shipping. It is thus possible to transport and intermediately warehouse a sheet-metal panel or slat 2 freshly glued to the reinforcing strut means 7 and subjected to the shape-mating connection described above.

As mentioned hereinabove, the two reinforcing strut means 7, provided at the marginal zones 5 extending in the direction of movement of the door leaf, are encompassed by a reinforcing profile 18 which is attached respectively from the side onto the reinforcing strut means 7 and the wall zone of the sheet-metal panel glued thereto, receiving these glued-together parts between them, in the manner of a bracket. The reinforcing profile 18 is held in this attached position by the feature that, in the zone of its two ends 19 at the front face, respectively one mating tab 20 is punched out which projects in the manner of a lug in the direction of movement of the door leaf, this mating tab being positioned in such a way that is can be introduced by bending into the space of the opening 15 in the associated edge 6 left vacant between the mutually facing shoulders of the bent projections 14. The bent-away position is represented on the right-hand side in FIG. 5 in dashed lines. The width of the mating tab 20 seen vertically to the direction of movement of the door leaf, is dimensioned so that the spacing to the adjoining curvatures of the projections 14 is at a minimum. This has the result that the laterally attached reinforcing profile is fixedly mounted to the sheet-metal panel or slat 2, secure against sliding off. Since the covered reinforcing profile 18, for reasons of ruggedness, is provided with embossings in the longitudinal direction of the marginal zones 5 of the panel 2, it is recommended that the bending away of the mating tab 20 from the profile plane be facilitated by a bending zone perforation illustrated in FIG. 5 on the right-hand side.

As shown in FIGS. 2, 4, and 5, the mutually adjoining zones of the angled portions 3 of the sheet-metal panel 2, edge 6, of the associated end sections 13 of the reinforcing profiles 7 and, in case of the marginal zones 5, the end zones 19 of the reinforcing profiles 18, are respectively provided with bores 22, namely, respectively, one bore as seen in the direction of the longitudinal rims 4 on both sides of the openings 15 and, respectively projections 14, and optionally of the mating tabs 20. In the contact zone, the bores 22 are in alignment with one another so that, per junction point, two threaded bolts can be passed through the bores 22. In case this junction zone is adjoined by a correspondingly designed junction zone of an adjacent door leaf member of the same type of construction, the threaded bolts extend through corresponding bores in a connecting tab of a hinge bridging the two junction zones with articulation. In case the junction zones lie in the upper and lower marginal zones of the door leaf finished from the door leaf members, the threaded bolts extend through the bores 22 without the presence of a hinge tab.

The connection of the parts of the door leaf member is thus of a variegated character, first of all over a large area by a noise-damping adhesive, then by the engagement of projections and/or tabs in openings for stabilizing the dimensional configuration and transportability of the individual door member, and finally by threaded bolts, thus secured fixedly and, in a conventional manner, against breaking apart, once the door leaf members have been composed into a door leaf.

The special advantage of the structure of the door leaf member according to this invention resides in the fact that, besides its noise damping, the individual parts can be surface-treated, before being combined, against the effects of weather, such as rust formation and the like, without interfering with the assembly. Thus, it is possible, for example, to provide the sheet-metal panels, in the form of a planar strip, already with a baked-in paint coat, a coating, or the like, and only then shape the panel into the laminate profile. This leads, in addition to attaining a rust-protected design of the door leaf member, to a considerably simplified manufacture.

I claim:

1. Laminate door leaf member of a sectional multi-leaf overhead door adapted to be moved vertically or horizontally into a closed position, the door leaf member comprising a laminate sheet-metal portion and substantially C-shaped angled portions provided along longitudinal edges thereof and disposed so as to open towards each other and located on the side of the sheet-metal portion which faces an interior of an area to be closed, reinforcing strut means extending in a direction perpendicular to a direction of the longitudinal edges and in a direction of movement of the door provided at least at one of marginal zones of the door leaf member and also between the marginal zones for stabilizing the door leaf member, said reinforcing strut means being in contact with said laminate sheet-metal panel of the door leaf member, adhesive means securing said reinforcing strut means in a contact zone of the reinforcing strut means to an inside surface of the laminate sheet-metal panel, connection means providing a shape mating connection between the C-shaped angled portions and said reinforcing strut means including lug-shaped projections provided in one of the respective end sections of each reinforcing strut means or inner side walls of the C-shaped angled portions, and corresponding openings in the other of said end sections and inner side walls, said lug-shaped projections extending through and over the edges of said openings and being adapted to engage without any substantial play one of of openings provided in either the inner side walls of the C-shaped angled portions or said end sections of the reinforcing strut means, as viewed in a longitudinal direction of the reinforcing strut means.

2. Door leaf member according to claim 1, wherein the lug-shaped projections (14) are punched out of the end sections of the reinforcing strut means and are bent around the edges of said openings which are formed in the inner side walls of the C-shaped angled portions said openings being substantially rectangular.

3. Door leaf member according to one of claims 1 or 2, wherein the reinforcing strut means arranged at the marginal zones of the laminate door leaf member are each overlapped by a reinforcing profile means attached from an outside of the marginal zones and grasping the marginal reinforcing strut means and the laminate metal-sheet panel in contact with the reinforcing strut means by the adhesive means, and wherein end zones of the reinforcing profile means are located so as to extend over the edges of the C-shaped angled portions and over the end sections of the reinforcing strut means with a mating tab being bent so as to be in engagement with the opening of the edge in such a manner that the mating tab engages at least approximately with a small clearance in between the projections bent into the opening.

4. Door leaf member according to claim 3, wherein at least one of the lug-shaped projections or the mating tabs are respectively bent around contacting rims of the openings and extend behind the same.

5. Door leaf member according to claim 1, wherein a wall of the laminate sheet-metal panel extending in a plane of the door leaf member is provided with corrugations extending approximately orthogonally to the reinforcing strut means, said corrugations projecting from the wall over the inside of the laminate sheet-metal panel and engaging in recesses in the reinforcing strut means, and wherein rims of said recesses surround the corrugations at a large clearance without a layer of the adhesive means.

6. Door leaf member according to claim 1, wherein the adhesive means includes a plurality of permanently elastic adhesive layers.

7. Door leaf member according to claim 1, wherein bores are longitudinally spaced in the C-shaped angled portions in the edges of the latter on one of both sides of the openings or of the projections of the reinforcing strut means, said bores being in alignment with corresponding bores in end sections of the reinforcing strut means and with correspondingly dimensioned and arranged bores in the reinforcing profile means, and receiving threaded bolts which are adapted to receive adjoining further door leaf members through bores of hinge tabs.

* * * * *